US005722026A

United States Patent [19]

Goto et al.

[11] Patent Number: 5,722,026

[45] Date of Patent: Feb. 24, 1998

[54] PRESSING ROTATOR AND HEATING-FIXING APPARATUS USING THE SAME

[75] Inventors: Masahiro Goto, Mishima; Toshio Miyamoto; Satoru Izawa, both of Numazu, all of Japan

[73] Assignee: Canon Kabushiki Kaisha, Tokyo, Japan

[21] Appl. No.: 705,300

[22] Filed: Aug. 29, 1996

[30] Foreign Application Priority Data

Aug. 31, 1995 [JP] Japan ..... 7-223474

[51] Int. Cl.[6] ..... G03G 15/20

[52] U.S. Cl. ..... 399/333; 492/56; 399/331

[58] Field of Search ..... 399/333, 330, 399/328, 331; 492/56, 53, 48; 219/216

[56] References Cited

U.S. PATENT DOCUMENTS

| | | | |
|---|---|---|---|
| 4,804,576 | 2/1989 | Kuge et al. . | |
| 4,883,715 | 11/1989 | Kuge et al. . | |
| 5,153,660 | 10/1992 | Goto . | |
| 5,253,024 | 10/1993 | Okuda et al. . | |
| 5,253,027 | 10/1993 | Goto | 399/333 |
| 5,285,245 | 2/1994 | Goto et al. . | |
| 5,331,385 | 7/1994 | Ohtsuka et al. . | |
| 5,376,996 | 12/1994 | Sankaran . | |
| 5,420,679 | 5/1995 | Goto et al. . | |
| 5,561,511 | 10/1996 | Mizunuma et al. | 399/333 |

FOREIGN PATENT DOCUMENTS

| | | |
|---|---|---|
| 186 314 | 7/1986 | European Pat. Off. . |
| 4011771 | 10/1990 | Germany . |
| 61-9678 | 1/1986 | Japan . |
| 61-231578 | 10/1986 | Japan . |
| 63313182 | 12/1988 | Japan . |
| 1-100581 | 4/1989 | Japan . |
| 2157878 | 6/1990 | Japan . |
| 444081 | 2/1992 | Japan . |
| 444080 | 2/1992 | Japan . |
| 444079 | 2/1992 | Japan . |
| 444078 | 2/1992 | Japan . |
| 444077 | 2/1992 | Japan . |
| 444076 | 2/1992 | Japan . |
| 444083 | 2/1992 | Japan . |
| 444082 | 2/1992 | Japan . |
| 444075 | 2/1992 | Japan . |
| 4-060570 | 2/1992 | Japan . |
| 4-110881 | 4/1992 | Japan . |
| 4204980 | 7/1992 | Japan . |
| 4204981 | 7/1992 | Japan . |
| 4204983 | 7/1992 | Japan . |
| 4204984 | 7/1992 | Japan . |
| 4204982 | 7/1992 | Japan . |
| 7-013451 | 1/1995 | Japan . |
| 7-036304 | 2/1995 | Japan . |

*Primary Examiner*—R. L. Moses

*Attorney, Agent, or Firm*—Fitzpatrick, Cella, Harper & Scinto

[57] ABSTRACT

To provide a pressing rotor for a heating-fixing apparatus to permanently fix a toner image transferred onto a recording material by passing the image through a nip portion formed by a heating rotator and a pressing rotator, in which the pressing rotator has an elastic layer and a surface layer, and the surface layer is a tube made of a mixture of a fluororesin and a high-friction-factor resin having a friction factor higher than that of the fluororesin, and moreover, provide a heating-fixing apparatus comprising a pressing rotator of the above structure.

15 Claims, 4 Drawing Sheets

PRESSING ROTATOR AND HEATING-FIXING APPARATUS USING THE SAME

BACKGROUND OF THE INVENTION

1. Field of the Invention

The present invention relates to a heating-fixing apparatus used for an electrophotographic recording apparatus and a heating rotator used for the heating-fixing apparatus.

2. Related Background Art

Most conventional electrophotographic type copiers and printers use a contact-heating type heat-roller fixing system superior in thermal efficiency and safety or an energy-saving type film heating system as fixing means.

A heating-fixing apparatus using the heat-roller fixing system basically comprises a heating roller (fixing roller) serving as a heating rotator and an elastic pressure roller brought into a pressure contact with the heating roller and serving as a pressing rotator. In this apparatus, this pair of rollers is rotated to introduce a recording material (transfer material sheet, electrostatic recording paper, electrofax paper, printing paper, or the like) carrying an unfixed image (toner image) as a material to be heated, to a pressure contacting nip portion formed by the pair of rollers, and then the recording material is conveyed and caused to pass through the nip portion, so that the unfixed image is heat-pressure-fixed onto the recording material as a permanently fixed image by action of the heat from the heating roller and the pressure at the nip portion.

Moreover, a fixing apparatus according to the film heating system is disclosed in, for example, Japanese Patent Laid-Open Application Nos. 63-313182, 2-157878, 4-44075 to 4-44083, and 4-204980 to 4-204984, which is an apparatus for pressing a heat-resistant film (fixing film) serving as a heating rotator against a heating element by a pressing rotator (elastic roller) and sliding and carrying the film, holding the heat resistant film, introducing a recording material carrying an unfixed image into a pressure-contacting nip portion formed by the heating element and a pressure member, and fixing the unfixed image on the recording material as a permanent image by the heat of the heating element and the pressure of the pressure-contacting nip portion.

Because the film-heating-type heater can use a small-heat-capacity linear heating element as its heating element and a small-heat-capacity thin film as its film, power saving and shortened waiting time (improvement of quick starting property) are realized.

Moreover, the following systems are known as this type of the fixing system: a system of providing a driving roller at the inner periphery of a fixing film and driving the film while tension is given to it, and a system of rotating a film following a pressing rotator by loosely fitting the film into a film guide and driving the pressing rotator. However, the latter pressing rotator-driving system is often used in recent years because it requires a less number of parts.

Moreover, in recent years, speed-up is strongly requested not only for the heating-fixing apparatus of the above pressure roller-driving type film system but also for a heat-roller fixing apparatus or fixing film-driving type heating-fixing apparatus and at the same time, downsizing of an image forming apparatus is required.

To make these apparatuses meet the above requirements, it is inevitable to use small-diameter, fixing roller and pressure roller and apply a relatively low pressure. When the image forming apparatus has a high speed of carrying a recording material, it is necessary to increase the pressure-contacting nip width between a fixing roller or fixing film and a pressure roller even at a low pressure in order to supply a sufficient quantity of heat to the recording material.

Therefore, it is attempted to develop a pressure roller whose roller hardness is extremely decreased.

In the case of the above heating-fixing apparatus using the system of rotating a film following a pressure roller by loosely fitting the film into a film guide and driving the pressure roller, a slip occurs between the pressure roller and a recording material and thereby, the recording material may not smoothly be carried when it is caused to pass between the film and the pressure roller if the driving-carrying force by a pressure roller is insufficient. Particularly, the above phenomenon easily occurs when the surface layer of the pressure roller is formed with a PFA (tetrafluoroethylene-perfluoroalkyl vinyl ether copolymer) tube superior in the mold release characteristic and durability. Moreover, the phenomenon more easily occurs as the image forming speed (almost equal to the peripheral speed of a pressure roller) of an image forming apparatus increases.

Therefore, the above PFA-tube pressure roller which is widely used in the heat-roller fixing system or the fixing film-driving type film fixing system is not frequently used in the pressure roller-driving type heating-fixing apparatus. Instead, a pressure roller in which a silicone rubber layer is formed on the mandrel or a pressure roller in which the above silicone rubber layer is coated with a fluororesin-contained fluororubber latex is used. However, these types of pressure rollers have a disadvantage that they are inferior in the durability to a pressure roller with a PFA tube provided as its surface layer. Moreover, in the case of coating with the fluororesin-contained fluororubber latex, the driving-carrying force by the pressure roller is not sufficient because the fluororesin is unevenly distributed on the surface side of the coating layer.

Moreover, in the case of a pressure roller-driving type film fixing apparatus, the speed of carrying a recording material or a film is determined by the peripheral speed of the pressure roller of the apparatus. Therefore, if the pressure roller serving as a driving roller has a large thermal expansion, the peripheral speed easily changes, the recording material is pulled by a heating-fixing apparatus when the material lies across an image forming section such as an image transfer section and the heating-fixing apparatus, and thus a formed image is extended or moved.

To mitigate the problem, it is necessary to decrease the thermal expansion coefficient of the pressure roller. However, when the wall thickness of the elastic layer is decreased in order to make the thermal expansion coefficient smaller, it is difficult to obtain a sufficient width of the pressure contacting nip and particularly difficult to deal with speeding up of the operation of the heating-fixing apparatus.

Also for this phenomenon, by forming a resin tube layer like that of a PFA tube as a surface layer of the pressure roller, it is possible to control the outside-diameter change of the roller due to thermal expansion of the elastic layer by the action of the resin tube or the thermal expansion of the layer because a stress works from the outer periphery of the roller. As a result, the change in the outside diameter of the pressure roller can be minimized. In the case of the above pressure roller-driving type apparatus, however, a slip occurs between the pressure roller and the recording material and thereby, the recording material may not smoothly be carried. Therefore, the pressure roller cannot directly be used.

Moreover, to obtain a large nip width by using a low-hardness pressure roller in a fixing roller- or fixing film-driving-type heating-fixing apparatus, the deformation of the elastic layer of the pressure roller is greatly increased, the rotating driving force, or torque from the fixing roller or fixing film is not completely transmitted to the mandrel of the pressure roller due to influence of stress distribution in the elastic layer, and the pressure roller causes a braking action and thereby a slip occurs when the friction force between a recording material passing through a nip and a fixing roller or fixing film decreases similarly to the above described case.

SUMMARY OF THE INVENTION

It is an object of the present invention to provide a pressing rotator for providing a conveying or carrying force for a member driven for rotation and held in a nip portion formed by bringing facing members into a pressure contact as well as a heating-fixing apparatus comprising the pressing rotator.

It is another object of the present invention to provide a pressing rotator free from surface contamination for a long time, and having a stable mold release characteristic, or use durability, exhibiting constantly preferable member-carrying characteristic so that no slip of the member held in the nip portion occurs, and further making it possible to stabilize the member-carrying speed by controlling thermal expansion and deal with increased operation speed of the apparatus as well as a heating-fixing apparatus comprising the pressing rotator.

It is a further object of the present invention to provide a pressing rotator for obtaining a large nip width by using a low-hardness elastic layer, and a heating-fixing apparatus using the pressing rotator, wherein the pressing rotator is free from surface contamination for a long time, and having a stable mold release characteristic, or use durability, exhibiting constantly preferable member-carrying characteristic so that no slip of the member held in the nip portion occurs, and further making it possible to deal with increased operation speed of the apparatus.

According to an aspect of the present invention, there is provided a pressing rotator for a heating-fixing apparatus for permanently fixing a toner image transferred onto a recording material by passing the image through a nip portion formed by a heating rotator and a pressing rotator, in which the pressing rotator has an elastic layer and a surface layer, and the surface layer is a tube made of a mixture of a fluororesin and a high-friction-factor resin having a friction factor higher than that of the fluororesin.

Moreover, according to another aspect of the present invention, there is provided a heating-fixing apparatus for permanently fixing a toner image transferred onto a recording material by passing the image through a nip portion formed by a heating rotator and the above-mentioned pressing rotator.

When the pressing rotator meets the above structural requirements, it is possible to secure stable mold release characteristic or use durability free from surface contamination for a long time and it is also possible to prevent a slip with a member held by a nip portion and obtain preferable member carrying characteristic, and moreover it is possible to stabilize the member carrying speed by controlling thermal expansion of the pressing rotator according to the action of a resin tube serving as a mold release layer of the surface layer and completely deal with increase of the operation speed of a heating-fixing apparatus for transmitting the rotating-driving force, or torque from the pressing rotator.

Moreover, it is possible to completely deal with increase of the operation speed of and decrease of the size of a heating-fixing apparatus for transmitting the torque from a fixing roller or fixing film.

Particularly, since a fluororesin superior in the mold release characteristic and a high-friction-factor resin superior in the member carrying characteristic are simultaneously present in the surface of the surface layer of the pressing rotator, the pressing rotator can be protected from being contaminated with toner, and a slip between a member held by a nip portion and the pressing rotator can be presented.

DESCRIPTION OF THE PREFERRED EMBODIMENT

It is preferable to use a fluororesin with a friction factor 0.3 or less for forming the surface layer of a pressing rotator. Moreover, it is preferable to use a high-friction-factor resin with a friction factor of 0.5 or more, particularly 0.6 or more for forming the surface layer of the pressing rotator. In this case, the friction factor (μ) is defined as shown below.

The friction factor (μ) is obtained by the following expression from a force F (kg) required to move a sample put on a horizontally disposed, mirror-finished steel plate at a velocity of 3 m/min by applying a load of 7 kg/cm$^2$ to the sample.

$$\mu = \frac{Fkg}{7\ \mathrm{kg/cm^2} \cdot Scm^2}$$

Where, S: Area of sample contacting steel plate

The fluororesin includes, for example, PFA (tetrafluoroethylene-perfluoroalkyl vinyl ether copolymer), PTFE (polytetrafluoroethylene), FEP (tetrafluoroethylene-hexafluoropropylene copolymer), and EPE (tetrafluoroethylene-hexafluoropropyleneperfluoroalkyl vinyl ether copolymer).

The high-friction-factor resin includes, for example, PEEK (polyether ether ketone), PPS (polyphenyl sulfide), silicone rubber, fluororubber, polyimide, and polyamide.

It is preferable to mix 5 to 25 parts by weight of a high-friction-factor resin with 100 parts by weight of fluororesin.

Moreover, to further improve the member carrying characteristic of the pressing rotator, it is preferred to set the surface roughness of the surface layer to 0.5 to 2.5 μm (JIS. Ra). Furthermore, to improve the member carrying characteristic by forming regular unevenness on the surface of the surface layer, it is preferable to keep the unevenness depth (H) in a range of 3 to 10 μm and the unevenness interval in a range of 0.1 to 1 mm. It is preferable that the elastic layer of the pressing rotator has a hardness of 5 degree (JIS A) or less so that the pressing rotator has a sufficient nip width between the rotator and a facing member. Moreover, it is preferable to keep the deformation rate of the elastic layer at 5% or more.

Figure 9:
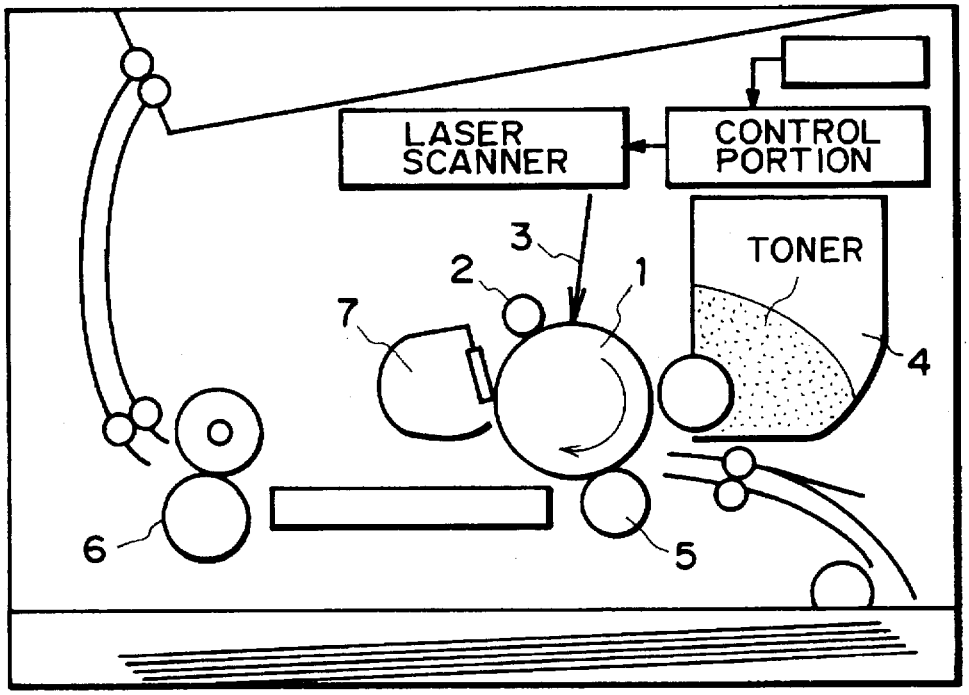
FIG. 9 is a schematic sectional view showing the outline of an image forming apparatus to which a heating-fixing apparatus of the present invention is applied.

FIG. 9 shows an image forming apparatus of the present invention.

In FIG. 9, numeral 1 denotes a photosensitive drum which is constituted by forming a photosensitive material such as OPC, amorphous Se, or amorphous Si on a substrate on a cylinder made of aluminum or nickel. Photosensitive drum 1 is rotated in the direction of the arrow and its surface is first uniformly electrified by an electrification roller 2 serving as an electrification apparatus.

Then, scanning exposure is performed by turning on/off laser beam 3 serving as exposure means in accordance with image information, so that an electrostatic latent image is formed. The electrostatic latent image is developed by development apparatus 4 and visualized.

The development method uses jumping development method or two-component development method, and image exposure and reverse development are frequently used in combination. A visualized toner image is transferred from photosensitive drum 1 onto transfer material P paper-fed and carried at a predetermined timing by transfer roller 5 serving as a transfer apparatus.

Transfer material P holding the toner image is carried to fixing apparatus 6, heated and pressed in the nip portion of the fixing apparatus, and finally fixed on the transfer material to be finished as a permanent image. Residual transfer toner remaining on photosensitive drum 1 after transfer is removed from the surface of photosensitive drum 1 by cleaner 7.

[Embodiment 1]

Figure 1:
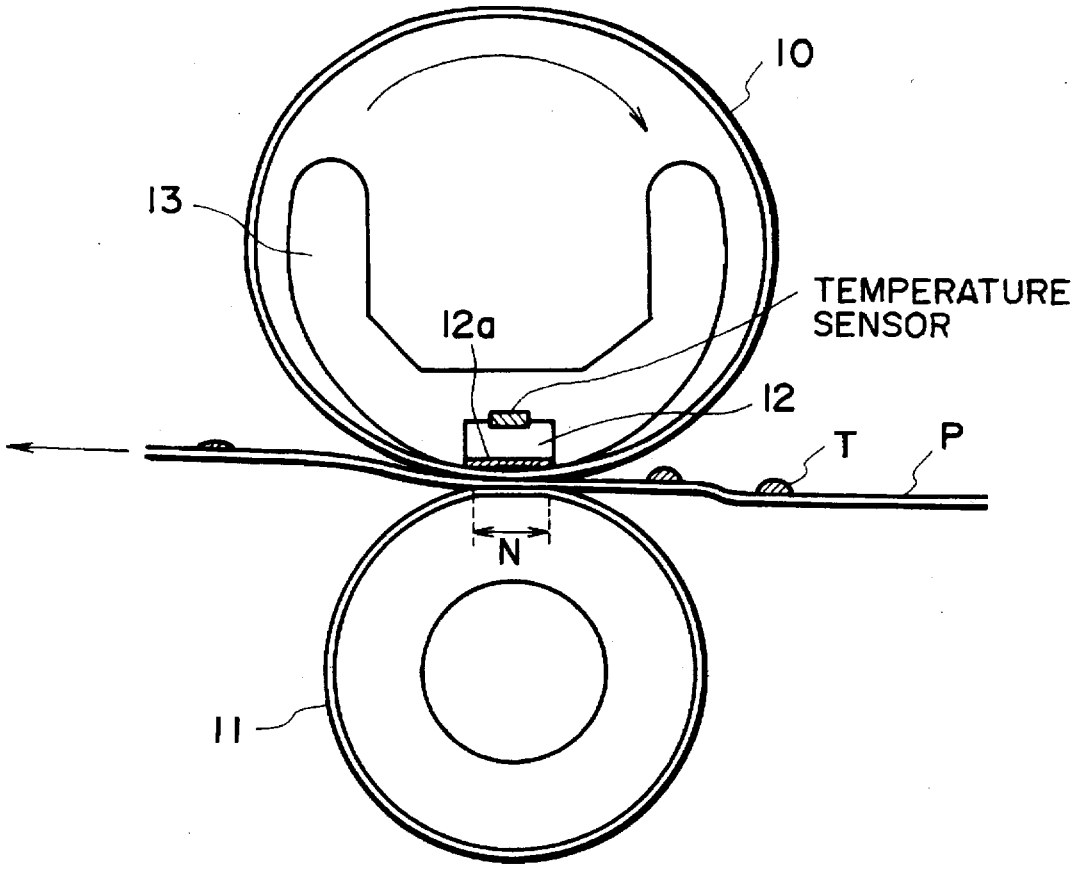
FIG. 1 is a schematic sectional view showing the outline of the heating-fixing apparatus of an embodiment of the present invention.

FIG. 1 shows a schematic sectional view of a film-heating-type fixing apparatus to which the first embodiment of the present invention is applied.

In FIG. 1, numeral 10 denotes an endless-belt heat-resistant film (fixing film) which is externally fitted to semi-circular-arc film guide member (stay) 13 so as to have a clearance in circumference.

To improve the quick start characteristic of film 10 by decreasing its heat capacity, film 10 may have a total thickness of 100 μm or less, preferably in a range of 60 to 20 μm, and the film may be a single layer film of PTFE, PFA, or PPS superior in heat resistance, mold release characteristic, strength and durability and may be a composite layer film formed by coating the surface of a film of polyimide, polyamide-imide, PEEK or PES with PTFE, PFA, or FEP as a mold release layer.

Numeral 11 denotes a pressure roller serving as a pressing rotator which is obtained by forming an elastic layer made of silicone rubber on an iron or aluminum mandrel.

In FIG. 1, film 10 is driven for rotation by rotation of pressure roller 11 without creasing at a predetermined peripheral speed, that is, a peripheral speed almost equal to the speed of carrying transfer material P holding unfixed toner image T sent from a not-illustrated image forming section while film 10 is brought into close contact with and slided on the surface of heating body 12 in the clockwise direction shown by the arrow at least while the image fixing is executed.

Heating body 12 includes electric heating element (resistance heating element) 12*a* and rises in temperature when electric heating element 12*a* produces heat.

While heating body 12 is heated by supplying electric power to electric heating element 12*a* and film 10 is rotated, transfer material P is introduced into pressure contacting nip portion N (fixing nip portion) formed between pressure roller 11 and heating body 12 by the elasticity produced due to deformation of the elastic layer of pressure roller 11 and thereby, transfer material P is brought into close contact with film 10 so that it is caused to pass through fixing nip portion N in the overlapping state.

When transfer material P passes through the fixing nip portion, heat energy is supplied to transfer material P from heating body 12 through film 10, and unfixed toner image T is heated and melted and fixed onto transfer material P. Transfer material P is separated from film 10 and discharged after passing through the fixing nip portion.

Figure 2:
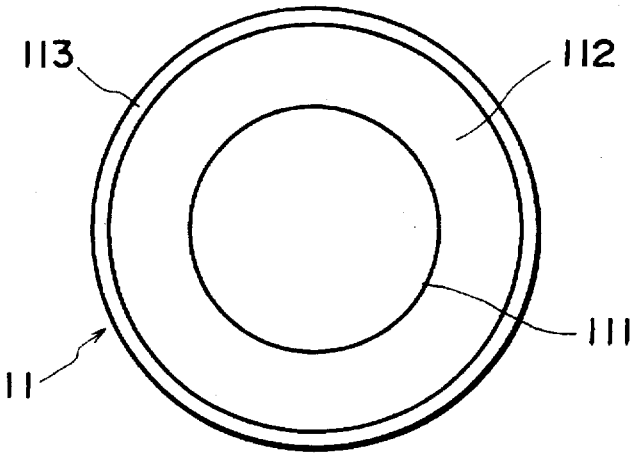
FIG. 2 is a schematic sectional view of a pressing rotator applied to a heating-fixing apparatus of the present invention.

Then, pressure roller 11 used for the heating-fixing apparatus of this embodiment is described below in detail by referring to FIG. 2.

Pressure roller 11 is obtained by applying surface-roughing such as blasting to an iron or aluminum mandrel, cleaning it, then cylindrically inserting mandrel 111, injecting a liquid silicone rubber into a mold, and heating it for curing. In this case, to form a tube layer serving as a mold release layer on the surface layer of the pressure roller, a tube to whose inner surface primer is previously applied is inserted into the mold. Thereby, rubber is heated and cured and simultaneously the tube is bonded with the rubber layer. After the pressure roller thus molded is released from the mold, secondary curing is applied to the pressure roller.

The above tube can tubularly be molded so as to have a predetermined outside diameter and thickness by adding PFA pellets and heat-resistant resin pellets such as PEEK or PPS with a friction factor higher than that of PFA and simultaneously extruding them when the tube is extrusion-molded.

Then, the following study was performed in order to evaluate the mold release characteristic of the tube layer and the slip characteristic for a recording material when applying the above pressure roller to the image forming apparatus of this embodiment and determine an optimum amount of a high-friction-factor resin to be mixed with the tube layer and the surface roughness of the tube.

After the pressure roller is molded, the surface of the tube layer is controlled to a predetermined roughness by sand blasting, sandpapering, or grindstone polishing.

The pressure roller was obtained by using an aluminum member with an outside diameter of 16 mm as mandrel 111, forming silicone rubber layer 112 with a thickness of 3 mm on mandrel 111, and moreover forming tube layer 113 with a thickness of 50 μm on silicone rubber layer 112. A nip was formed by applying a load of total pressure of 12 kg to the fixing film and heating body. The fixing film is prepared by forming a PTFE layer with a thickness of 10 μm on a polyimide seamless tube with a thickness of 50 μm.

In this case, an electric power of 700 W was supplied to the heating body and the pressure roller was rotated at a peripheral speed of 150 mm/sec, evaluation of slip between the pressure roller and the transfer material was performed by continuously feeding 100 A4-size sheets obtained by leaving them under an environment at a temperature of 30° C. and a humidity of 80% for 24 hr or more and observing how many slips occurred and the surface mold release characteristic was examined by continuously feeding 300,000 A4-size sheets under an environment at ordinary temperature and ordinary humidity and visually confirming the number of sheets in which the pressure roller surface was contaminated by toner.

Moreover, the above slip evaluation was performed whenever 100,000 sheets were fed to confirm the durability change of the slip characteristic during the continuous use.

As the result of performing the above evaluation, it is found that a pressure roller capable of meeting the slip characteristic and mold release characteristic is obtained by mixing 5 to 20 parts by weight of heat-resistant resin with a friction factor higher than that of PFA of PEEK (friction factor: 0.65) or PPS (friction factor: 0.6) with 100 parts by weight of PFA (friction factor: 0.2) in a tube layer and moreover, keeping the surface roughness Ra (central-line average surface roughness) of the tube layer in a range of 0.5 to 1.5 μm.

As for the mixing amount of the high-friction-factor resin, it is found that the slip performance is not satisfied if the mixing amount of the resin is less than 5 parts by weight and it is lowered as the surface is abraded during the repetitive use though a sufficient slip performance is initially obtained even when the surface is completely roughened.

Moreover, when the surface is excessively roughened, toner contamination occurs from an early stage. However, when the mixing amount of the high-friction-factor resin is larger than 20 parts by weight, toner contamination occurs even if the tube surface is almost mirror-finished. As for the surface roughness of the tube layer, when the surface was not roughened (Ra is 0.3 μm or less), several slips occurred every 100 times of the above 100-sheet feed evaluation particularly at the start of using the pressure roller though 20 parts by weight or more of the high-friction-factor resin were mixed.

Moreover, when the surface is excessively roughened, toner contamination easily occurs because the toner easily enters a recess.

As described above, it is possible to obtain a pressure roller superior in the mold release characteristic for a long time and stabilized in the paper carrying characteristic by mixing PFA with a high-friction-factor resin with a friction factor higher than that of PFA in the tube layer on the surface layer of the pressure roller and moreover roughening the surface. This embodiment uses PFA as fluororesin. However, the same function and advantage can be obtained by using fluororesin such as PTFE (friction factor: 0.1), FEP (friction factor: 0.3), or EPE (friction factor: 0.25).

[Embodiment 2]

This embodiment shows another embodiment of the pressure roller applied to the heating-fixing apparatus of embodiment 1. This embodiment is characterized by using a mixture of PFA and silicone rubber (friction factor: 0.8 to 1.0) or fluororubber (friction factor: 0.85 to 1.0) for a tube as the surface layer of a pressure roller and moreover, roughening the surface layer of the tube similarly to the case of embodiment 1.

In the case of this embodiment, because a rubber material is mixed in the tube, it is possible to obtain the same advantage as that of embodiment 1 with a small amount of the rubber material compared to the case of mixing a resin material because the rubber material has a very high friction factor and moreover, tube breakdown hardly occurs and it is possible to lower the roller hardness because the tube hardness lowers. Therefore, it is possible to provide a pressure roller suitable for further increase of the operation speed of an image forming apparatus.

As the result of applying the pressure roller of this embodiment to the heating-fixing apparatus and image forming apparatus of embodiment 1 and obtaining the optimum mixing amount of a rubber material and the tube surface roughness, it is found that a pressure roller satisfying the slip characteristic and mold release characteristic is obtained by mixing 3 to 20 parts by weight of the rubber material with 100 parts by weight of PFA and keeping the surface roughness Ra in a range of 0.1 to 1 μm.

[Embodiment 3]

Figure 3:
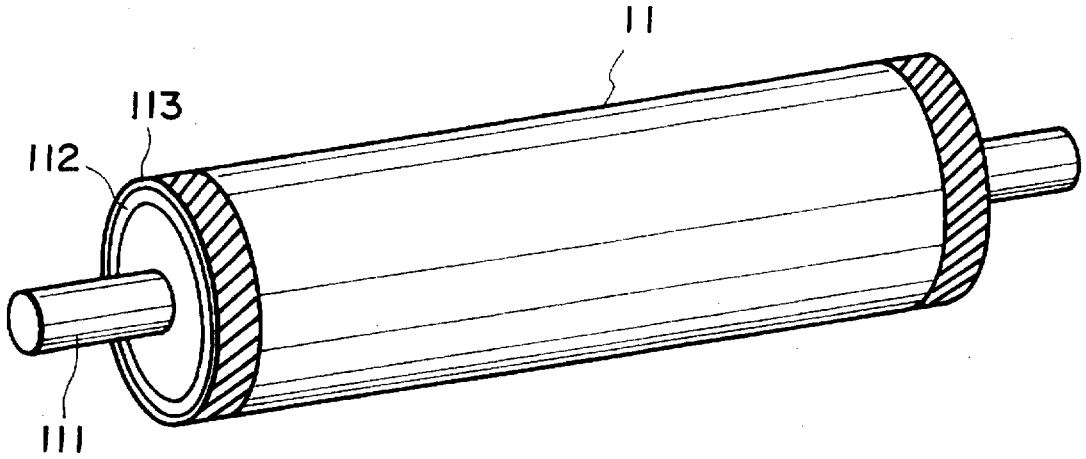
FIG. 3 is a schematic perspective view showing an embodiment of a pressing rotator applied to a heating-fixing apparatus of the present invention.

This embodiment shows still another embodiment of the pressure roller applied to the heating-fixing apparatus of embodiment 1. This embodiment is characterized by using a mixture obtained by mixing 5 to 20 part by weight of PEEK or PPS with 100 parts by weight of PFA or 3 to 20 parts by weight of silicone rubber or fluororubber with 100 parts by weight of PFA for a tube on the pressure roller surface layer and further applying the roughening same as that of embodiment 1 to the surface layer of the tube only at ends of the pressure roller (see the hatched portion in FIG. 3).

In this embodiment, a paper feed area (or image area) of the pressure roller is kept in a state after extrusion-molding of the above tube to maintain a very good mold release characteristic, and simultaneously a friction force is increased only at the ends to thereby increase the torque, or the fixing film-rotating force at the ends, so that the recording material can be prevented from slipping even under such a state that it tends to slip. As a result, it is possible to prevent the recording material from slipping and the pressure roller from being contaminated due to toner even under a state in which the contamination of the pressure roller is apt to occur like an image forming apparatus having an automatic both-side printing function.

As the result of performing the same evaluation as the case of embodiment 1, it is found that the surface roughness Ra at ends should be kept in a range of 0.8 to 2.5 μm. Moreover, it is found that, when the surface roughness is smaller than the above range, the recording material slips, and when the surface roughness is larger than the above range, the pressure roller is contaminated due to toner if the recording material is slightly deviated from the original paper feed position due to the bias or the like and the dimensional accuracy in the cross direction becomes very severe.

[Embodiment 4]

This embodiment shows still another embodiment of the pressure roller applied to the heating-fixing apparatus of embodiment 1. In the case of this embodiment, a tube on the pressure-roller surface layer uses a mixture obtained by mixing heat resistant resin such as PEEK or PPS or heat resistant rubber such as silicone rubber or fluororubber with PFA at the same rate as the case of embodiment 3 and moreover, the surface layer of the tube is slightly roughened by applying corona discharge or etching using an ammonium or naphthalene solution of metallic sodium to the surface and also slightly activated (locally defluorinated).

By performing the surface treatment of this embodiment, the friction factor of the tube surface layer increases in an area of 1 μm or less of the layer. Therefore, the sliding characteristic can be prevented from increasing because the initial outermost surface layer becomes rich in fluororesin which is a feature of the present mixture tube. Therefore, even if the surface layer is abraded due to repetitive use, it is possible to keep a sufficient gripping force to paper because a resin or rubber other than fluororesin serving as a high-friction member locally appears on the surface at this point of time.

Figure 4:
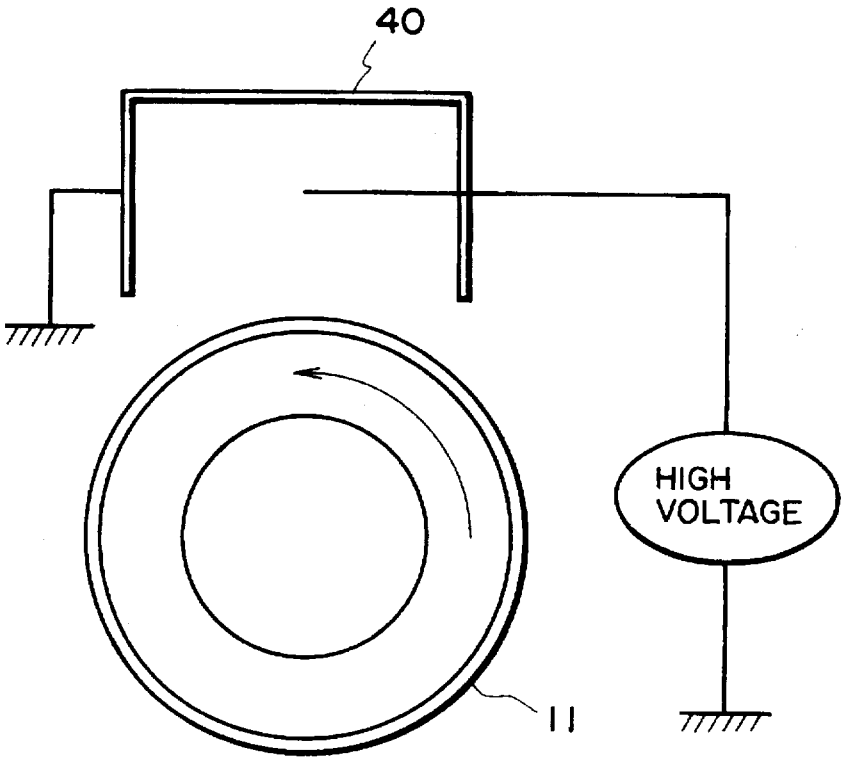
FIG. 4 is an illustration showing corona discharge of the fourth embodiment of the present invention.

To treat the surface, as shown in FIG. 4, a pressure roller is manufactured according to the manufacturing method same as the case of embodiment 1 or 2 and thereafter, the tube surface is activated by minus corona discharge from corona discharger 40. In this case, the surface activation is performed by applying a high voltage of −7 to 10 kV to corona discharger 40 to generate minus coronas, rotating the pressure roller at a predetermined rotational speed (20 to 100 rpm), and keeping the tube in a corona environment for 1 to 10 min.

It is confirmed by the evaluation method shown in embodiment 1 that functions and advantages of this embodiment can be obtained from the surface treatment method of this embodiment when the maximum surface roughness Rmax increases compared to that before treatment and is kept in a range of 0.7 to 3 μm though Ra and Rz which are values showing the surface roughness of the pressure-roller surface layer are almost the same as those before treatment.

The present treatment method has advantages that the method makes it possible to independently treat a tube before molding a pressure roller and particularly the method serves as a superior treatment method for mass production.

Moreover, this embodiment makes it possible to provide a heating-fixing apparatus in which a pressure roller is less contaminated due to toner by applying corona discharge or etching only to ends of the pressure roller similarly to the case of embodiment 3, particularly makes it possible to provide a pressure roller suitable for an image forming apparatus having an automatic both-side printing function.

[Embodiment 5]

This embodiment shows still another embodiment of the pressure roller applied to the heating-fixing apparatus of embodiment 1. This embodiment is characterized by using a mixture obtained by a mixing a heat resistant resin such as PEEK or PPS or a heat resistant rubber such as a silicone rubber or fluororubber with PFA at the same rate as the case of embodiment 3 and moreover, previously roughening the tube surface by post-treatment when or after molding the tube so that a specific uneven surface shape such as a knurled or embossed shape is obtained.

The treatment method of this embodiment makes it possible to form the tube surface shape into a smooth uneven shape and, at the same time, obtain pressure rollers with less shape fluctuation in mass production.

Figures 5A, 5B:
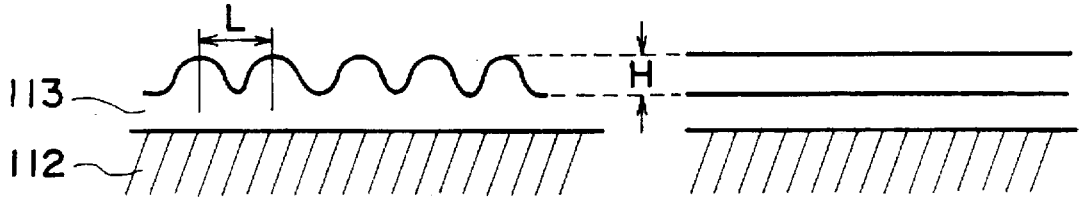
FIGS. 5A and 5B are schematic enlarged sectional views showing surface states of a pressing rotator of the fifth embodiment of the present invention.

FIGS. 5A and 5B show an example of the surface shape of this embodiment, in which jogs are formed like knurls in the rotational direction (FIG. 5A is an enlarged view of the surface shape of a pressure roller viewed from the sectional direction and FIG. 5B is an enlarged view of the surface shape of the pressure roller viewed from the width or cross direction). This shape is obtained by extrusion-molding a tube and thereafter pressing the tube while heating the tube surface (at 150° to 250° C.) by a mold whose inner surface is previously formed into the above knurl-like uneven shape.

Moreover, the same surface shape can be obtained by properly selecting a die shape for extrusion. In this case, by controlling the size of the jogs so that depth H of the jogs may be in a range of 3 to 10 μm and interval L between them may be in a range of 0.1 to 1 mm, it is possible to obtain a pressure roller capable of maintaining the mold release characteristic for a long time and on which a recording material does not slip.

Because the treatment method of this embodiment makes it possible to obtain smooth large jog shape, it is possible to prevent initial slip from occurring due to the effect of gripping a recording material by making the surface roughness large, and moreover, it is confirmed that toner contamination of the pressure roller surface less frequently occurs because of a smooth surface uneven shape. Same functions and advantages as those of the above-described embodiments are obtained as for the maintenance of slip preventive effect in repetitive use.

Figures 6A, 6B:
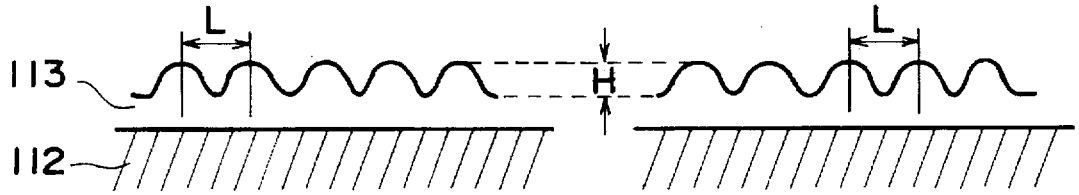
FIGS. 6A and 6B are schematic enlarged sectional views showing surface states of the pressing rotator of the fifth embodiment of the present invention.

FIGS. 6A and 6B show a surface uneven shape different from a knurled shape (FIG. 6A is an enlarged view of the pressure-roller surface shape viewed from the sectional direction and FIG. 6B is an enlarged view of pressure-roller surface shape viewed from the width or cross direction). Also for this embodiment, the surface uneven shape is obtained by pressing a tube after molding it and thereby transferring the internal shape of a mold. Moreover, as for depth H and interval L between jogs, the above functions and advantages can be obtained by maintaining the above values.

Though the above is all described by relating the present invention only to a pressure roller, it is needless to say that a belt-like rotator capable of transmitting torque can also be applied to the present invention as for the rotators of embodiments 1 to 5.

[Embodiment 6]

Figure 7:
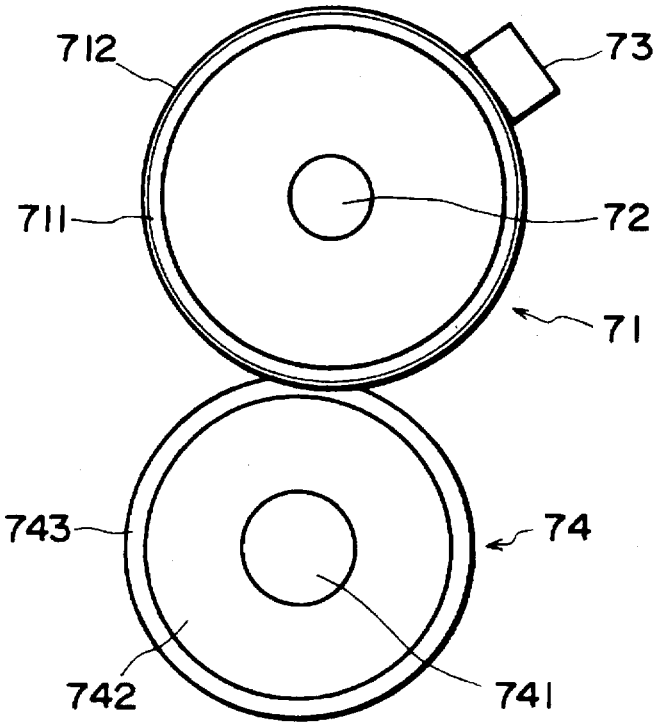
FIG. 7 is a schematic sectional view showing the outline of a heating-fixing apparatus of an embodiment of the present invention.

FIG. 7 is a schematic sectional view of a heating-fixing apparatus for explaining this embodiment 6. In the case of this embodiment, a heating-fixing apparatus uses a heat-roller fixing apparatus, and a pressing rotator uses a low-hardness rubber with an elastic-layer rubber hardness of 5 degree (JIS A) or less. In this case, it is assumed that the deformation rate of an elastic layer in a nip portion is 5% or more, and a resin or rubber with a friction factor higher than that of PFA is mixed with PFA in a tube layer of a surface-layer mold release layer. In this case, the elastic-layer deformation rate in the nip portion is defined as "(maximum deformation value of elastic layer)/(thickness of elastic layer)". The maximum deformation value of an elastic layer is defined as a value obtained by subtracting the minimum length of an elastic layer after deformed in the radius direction from the length of the elastic layer before deformed in the radius direction.

By using a heating-fixing apparatus having the above structure, it is possible to obtain a complete fixing characteristic in a high-speed image forming apparatus with a recording material-carrying speed of 150 mm/sec even when outside diameters of a fixing roller and a pressure roller are 30 mm or less and the pressure is 10 kg or lower. Functions and advantages of this embodiment are specifically described below.

Fixing roller 71 can be obtained by forming mold release layer 712 made of PEA or PTFE with a thickness of 10 to 50 μm on mandrel 711 made of aluminum or SUS. This embodiment uses a fixing roller with an outside diameter of 30 mm and a mandrel wall thickness of 2 mm. Heater 72 is set in the fixing roller as a heating source and it is possible to keep the surface of the fixing roller at a predetermined temperature by turning on/off heater 72 by a not-illustrated AC driver in accordance with a signal of temperature sensor 73 such as a thermistor provided on the surface layer of the fixing roller.

Pressure roller 74 is obtained by forming silicone rubber layer 742 on mandrel 741 made of iron or SUS as an elastic layer and moreover forming tube layer 743 on layer 742 as a mold release layer.

In the case of this embodiment, a silicone rubber layer with a thickness of 5 mm and a rubber hardness of 5 degree is formed on a mandrel with an outside diameter of 10 mm, a tube layer formed from a mixture of 100 parts by weight of PFA and 3 to 20 parts by weight of fluororubber is provided in a thickness of 50 μm on the silicone rubber layer. A nip is formed between the pressure roller and a fixing roller with the pressure roller being pressed to a predetermined pressure (10 kg for this embodiment) by not-illustrated pressure means such as a spring. As the result of applying a fixing apparatus having the above structure to an image forming apparatus with a recording material-carrying speed of 180 mm/sec and changing the pressure, a preferable fixing characteristic can be obtained when the elastic-layer deformation rate of the pressure roller at the central portion of the nip in its longitudinal direction is 5% or more.

That is, the advantages are obtained that a large-enough nip width is more easily obtained according to the peripheral shape of the fixing roller by increasing the elastic-layer deformation rate of the pressure roller and simultaneously, a large nip width can be obtained even if the pressure roller has a small heat capacity by decreasing the outside diameter, a quantity of heat to be taken by the pressure roller decreases and the thermal efficiency is improved, and moreover the fixing characteristic is improved.

Therefore, for example, when the outside diameter of the pressure roller is made large and the hardness of the rubber layer serving as an elastic layer is high, the fixing characteristic immediately after turning on a power supply may be insufficient at times even if the same nip width is apparently obtained because the pressure roller has a large heat capacity and moreover, the pressure-roller elastic layer is not completely deformed at the nip portion and therefore the recording material does not completely follow the periphery of the fixing roller. In the case of this embodiment, however, the above trouble does not occur.

Moreover, when a pressure roller with the same outside diameter and having a rubber layer with a higher hardness is used to obtain the same nip width as that of this embodiment by making the pressure higher, the fixing roller becomes deflected so that a uniform deformation rate of the rubber layer in the longitudinal direction cannot be obtained.

To obtain the functions and advantages of this embodiment, it is found that the rubber hardness of a rubber layer should be 5 degree (JIS A) or less and the deformation rate of the elastic layer should be 5% or more. As for the necessary deformation rate, it is considered that the pressure in a nip enough to fix a toner image cannot be obtained unless deformation of a certain rate or more occurs as the characteristic of the above low-hardness rubber in addition to the effect for decreasing the heat capacity of the pressure roller.

Moreover, when a normal PFA tube is provided for the heating-fixing apparatus having the above structure as a surface mold release layer, it is confirmed that a slip occurs on paper left in an temperament at a high temperature and a high humidity. That is, because the pressure-roller elastic layer completely follows the periphery of the fixing roller in a nip portion, there is no exit of water vapor produced by a recording material. Therefore, a water vapor film is formed between the pressure roller and the recording material, a driving force cannot completely be transferred between the fixing roller, recording material, and pressure roller, and thereby a slip occurs.

Therefore, this embodiment makes it possible to prevent the above slip phenomenon because a gripping force to the recording material is produced on the tube surface layer by using a mixture of PFA and fluororubber for the tube of the pressure-roller surface layer.

Specifically, as the result of performing the evaluation same as the case of embodiment 1 on the mold release characteristic of the tube layer and the slip characteristic of the recording material, it is found that a preferable result can be obtained when a mixing amount of fluororubber to be added to PFA is 3 to 20 parts by weight.

Moreover, it is found by the same evaluation 10 method that an optimum mixing amount of silicone rubber to be added to the tube is 3 to 20 parts by weight and an optimum mixing amount of heat resistant resin such as PPS or PEEK to be added to the tube is 5 to 25 parts by weight. In this case, the tube layer shows a preferable slip-resistant characteristic without being roughened.

It is estimated that this effect greatly depends on the structure for transmitting a carrying force to the recording material by driving the fixing roller unlike embodiments 1 to 5.

As described above, even in the case of a heat-roller fixing apparatus, particularly when an elastic body with a low hardness is used under the conditions for providing large deformation rate, it is possible to obtain a pressure roller causing no slip of a recording material during the carry within the nip and free from toner contamination during the use for a long time by using a tube mixed with PFA and a resin or rubber having a friction factor higher than that of PFA as the pressure-roller surface layer.

Moreover, it is possible to obtain a compact low-pressure fixing apparatus satisfying a high operation speed.

For this embodiment, functions and advantages of low-hardness silicone rubber are described. However, it is needless to say that the same functions and advantages can be obtained even by using a silicone sponge instead of the silicone rubber. In this case, however, a commercial sponge hardness meter is used to measure the hardness of the silicone sponge, and it is necessary that the sponge hardness meter shows a measured value equal to that of low-hardness silicone rubber with a hardness of 5 degree (JIS A) or less.

[Embodiment 7]

Figure 8:
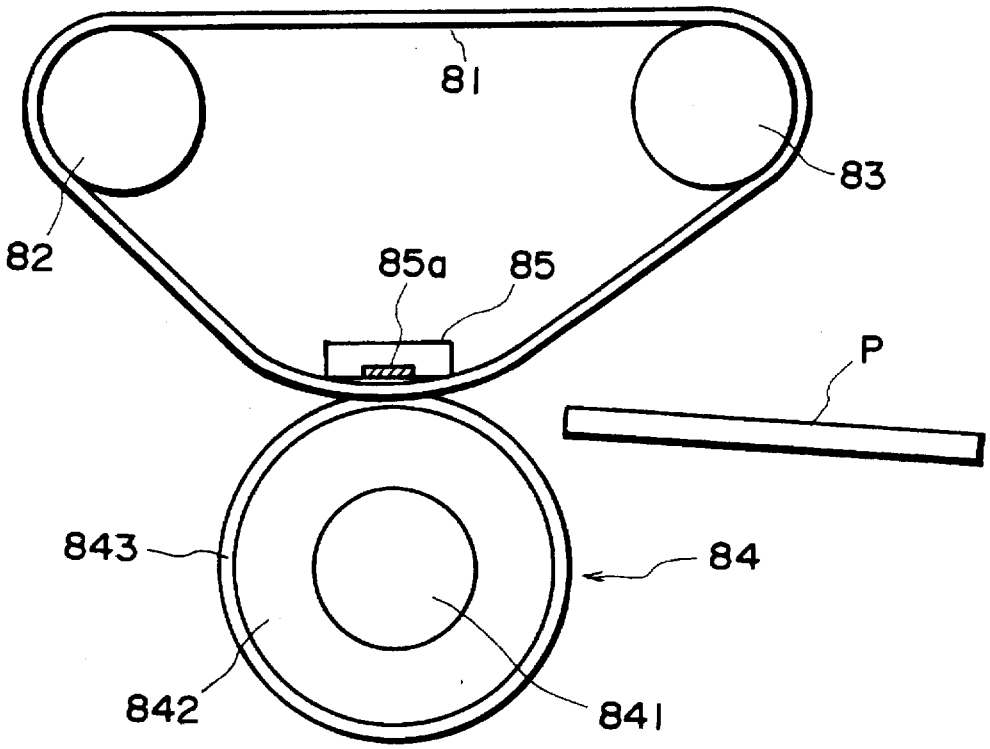
FIG. 8 is a schematic sectional view showing the outline of a heating-fixing apparatus of an embodiment of the present invention.

FIG. 8 is a schematic sectional view of a heating-fixing apparatus for explaining embodiment 7. In the case of this embodiment, a film fixing apparatus is used as a heating-fixing apparatus, and a case is described in which a film is driven from its inner periphery. In this case, as for the pressing rotator, the elastic layer is formed of a low hardness rubber with a rubber hardness of 5 degree or less, and the deformation rate of the elastic layer in a nip portion is set to 5% or more, and a tube layer as a surface mold release layer uses a mixture of PFA with a resin or rubber having a friction factor higher than that of PFA.

By using a heating-fixing apparatus having the above structure, it is possible to obtain a complete fixing characteristic even in a high-speed image fixing apparatus with a recording material-carrying speed of 150 mm/sec even when the outside diameter of the pressure roller is 30 mm or less and the pressure is 10 kg or less and moreover decrease the degree of curl of the recording material.

The heating-fixing apparatus of this embodiment is described below.

In FIG. 8, numeral 81 denotes an endless-belt-like heat resistant film (fixing film), and driving roller 82 and tension roller 83 for adjusting tension are provided on its inner periphery.

Film 81 is a single layer film of PTFE, PFA, or PPS superior in heat resistance, mold release characteristic, strength and durability or a composite layer film formed by coating the surface of a film of polyimide, polyamide-imide, PEEK or PES with PTFE, PFA, or FEP as a mold release layer. The film has a total thickness of 50 μm or less, preferably a total thickness from 30 to 15 μm in order to improve the quick start characteristic by decreasing the heat capacity.

Numeral 84 denotes a pressure roller serving as a pressing rotator which is constituted by forming elastic layer 842 made of silicone rubber on mandrel 841 made of iron or aluminum and further forming tube layer 843 serving as a mold release layer on the layer 842.

In FIG. 8, film 81 is rotated by rotation of driving roller 82 without creasing at a predetermined peripheral speed, that is, a peripheral speed almost equal to the speed of carrying transfer material P holding unfixed toner image T sent from a not-illustrated image forming section while film 81 is brought into a close contact with and slided on the surface of heating body 85 in the clockwise direction shown by the arrow at least during image fixing.

Heating body 85 includes electric heating element (resistance heating element) 85*a* and rises in temperature when electric heating element 85*a* produces heat.

While heating body 85 is heated by supplying electric power to electric heating element 85*a* and film 81 is rotated, transfer material P is introduced into pressure contacting nip portion N (fixing nip portion) formed between pressure roller 84 and heating body 85 by the elasticity produced due to deformation of the elastic layer of pressure roller 84 and thereby, transfer material P is brought into close contact with film 81 so that it is caused to pass through fixing nip portion N in the overlapping state.

When transfer material P passes through the fixing nip portion, heat energy is supplied to transfer material P from heating body 85 through film 81, and unfixed toner image T is heated and melted and fixed onto transfer material P. Transfer material P is separated from film 81 and discharged after passing through the fixing nip portion.

As the result of applying the heating-fixing apparatus obtained by forming a silicone rubber layer with a thickness of 5 mm and a rubber hardness of 5 degree onto a mandrel with an outside diameter of 10 mm and forming a PFA and fluororubber-mixed tube layer with a thickness of 50 μm on the silicone rubber layer as a pressure roller similarly to the case of embodiment 6 to an image forming apparatus with a recording material-carrying speed of 180 mm/sec, a preferable fixing characteristic can be obtained when the elastic-layer deformation rate of the pressure roller is 5% or more similarly to the case of embodiment 6. Moreover, as the result of evaluating the slip characteristic and mold release characteristic similarly to the case of embodiment 6, slip of the recording material does not occur or toner contamination of the pressure roller does not occur after a long-time use as long as the mixing ratio of the fluororubber is kept in a range of 3 to 20 parts by weight.

For this embodiment, functions and advantages of a film-driving-type heating-fixing apparatus are described. However, it is needless to say that the low-hardness silicone rubber is very effective also for increase of the operation speed of a pressure roller-driving type film fixing apparatus.

What is claimed is:

1. A pressing rotator for a heating-fixing apparatus for permanently fixing a toner image transferred onto a recording material by passing the image through a nip portion formed by a heating rotator and a pressing rotator; wherein said pressing rotator has an elastic layer and a surface layer, and said surface layer is a tube made of a mixture of a fluororesin and a high-friction-factor resin having a friction factor higher than that of the fluororesin.

2. A pressing rotator according to claim 1, wherein the fluororesin has a friction factor of 0.3 or less.

3. A pressing rotator according to claim 1, wherein the high-friction-factor resin has a friction factor of 0.5 or more.

4. A pressing rotator according to claim 1, wherein the fluororesin has a friction factor of 0.3 or less and the high-friction-factor resin has a friction factor of 0.6 or more.

5. A pressing rotator according to claim 1, wherein an elastic layer has a hardness of 5 degree or less.

6. A pressing rotator according to claim 1, wherein 5 to 25 parts by weight of the high-friction-factor resin are mixed with 100 parts by weight of the fluororesin in the surface layer.

7. A pressing rotator according to claim 1, wherein the surface layer has a surface roughness of 0.5 to 2.5 μm.

8. A pressing rotator according to claim 1, wherein the surface layer has a regular uneven surface shape, and depth H of jogs is kept in a range of 3 to 10 μm and interval L between them is kept in a range of 0.1 to 1 mm.

9. A pressing rotator according to claim 1, wherein the surface layer is formed at both ends of an elastic layer.

10. A pressing rotator according to claim 1, wherein said pressing rotator is a belt-like rotator capable of transmitting torque.

11. A heating-fixing apparatus for permanently fixing a toner image transferred onto a recording material by passing the image through a nip portion formed by a heating rotator and a pressing rotator; wherein said pressing rotator has an elastic layer and a surface layer, and said surface layer is a tube made of a mixture of a fluororesin and a high-friction-factor resin having a friction factor higher than that of the fluororesin.

12. A heating-fixing apparatus according to claim 11, wherein the fluororesin has a friction factor of 0.3 or less.

13. A heating-fixing apparatus according to claim 11, wherein the high-friction-factor resin has a friction factor of 0.5 or more.

14. A heating-fixing apparatus according to claim 11, wherein the fluororesin has a friction factor of 0.3 or less and the high-friction-factor resin has a friction factor of 0.6 or more.

15. A heating-fixing apparatus according to claim 11, wherein the elastic layer has a deformation rate of 5% or more in a nip portion.

* * * * *

UNITED STATES PATENT AND TRADEMARK OFFICE

CERTIFICATE OF CORRECTION

PATENT NO. : 5,722,026 
DATED : February 24, 1998
INVENTOR(S) : Masahiro GOTO, et al.

It is certified that error appears in the above-identified patent and that said Letters Patent is hereby corrected as shown below:

Title Page, [56] References Cited, right-hand column, first column (reference numbers), delete in its entirety: and insert therefor:

--61-231578
63-13182
1-100581
2-157878
4-44081
4-44080
4-44079
4-44078
4-44077
4-44076
4-44083
4-44082
4-44075
4-060570
4-110881
4-204980
4-204981
4-204983
4-204984
4-204982
7-013451
7-036304--.

UNITED STATES PATENT AND TRADEMARK OFFICE

CERTIFICATE OF CORRECTION

PATENT NO. : 5,722,026
DATED : February 24, 1998
INVENTOR(S) : Masahiro GOTO, et al.

It is certified that error appears in the above-identified patent and that said Letters Patent is hereby corrected as shown below:

Title Page, [57] Abstract, line 1, delete "rotor" and insert therefor --rotator--.

Column 11, line 56, delete "temperament" and insert therefor --environment--.

Column 12, line 9, delete "10".

Column 14, line 20, delete "degree" and insert therefor --degrees--.

Signed and Sealed this

Thirteenth Day of October 1998

*Attest:*

*Attesting Officer*

BRUCE LEHMAN

*Commissioner of Patents and Trademarks*